US005957159A

United States Patent [19]

Takahashi et al.

[11] Patent Number: 5,957,159

[45] Date of Patent: Sep. 28, 1999

[54] DIRECTIONAL CONTROL VALVE WITH FLOW DISTRIBUTION VALVES

[75] Inventors: Kinya Takahashi; Yoshizumi Nishimura, both of Tsuchiura; Yusaku Nozawa, Ibaraki-ken; Nobuhiko Ichiki, Ibaraki-ken; Minoru Aoki, Ibaraki-ken, all of Japan

[73] Assignee: Hitachi Construction Machinery Co., Ltd., Tokyo, Japan

[21] Appl. No.: 09/142,870

[22] PCT Filed: Jan. 20, 1998

[86] PCT No.: PCT/JP98/00197

§ 371 Date: Sep. 17, 1998

§ 102(e) Date: Sep. 17, 1998

[87] PCT Pub. No.: WO98/31940

PCT Pub. Date: Jul. 23, 1998

[30] Foreign Application Priority Data

Jan. 21, 1997 [JP] Japan ..... 9-008727

[51] Int. Cl.[6] ..... F15B 13/08

[52] U.S. Cl. ..... 137/596; 60/427; 60/452; 91/447; 91/518; 137/596.13

[58] Field of Search ..... 60/427, 452; 91/447, 91/518; 137/596, 596.13

[56] References Cited

U.S. PATENT DOCUMENTS 3,881,512 5/1975 Wilke .
5,305,789 4/1994 Rivolier .
5,315,826 5/1994 Hirata et al. ..... 91/446 X

FOREIGN PATENT DOCUMENTS 50-58625 5/1975 Japan .
62-33174 8/1987 Japan .
4-210102 7/1992 Japan .
4-48967 8/1992 Japan .
6-280805 10/1994 Japan .

*Primary Examiner*—Gerald A. Michalsky
*Attorney, Agent, or Firm*—Fay, Sharpe, Beall, Fagan, Minnich & McKee

[57] ABSTRACT

A pair of directional control valves 8 and a pair of hold check valves 9 are disposed respectively between a pair of metering notches 6, which are formed in a land 4-1 of a spool 2 and have functions of both flow rate control and direction control, and a pair of actuator ports A, B. Each hold check valve comprises a valve body 90 in the form of a hollow spool having a seat portion 12 formed on an outer periphery and being subject to a pressure developed in an outlet passage 10 communicating with one of the actuator ports to act in the valve-closing direction. Each flow distribution valve comprises a valve body 80 being slidably fitted in the valve body 90 and having a front surface positioned to face an inlet passage 7 communicating with the metering notch and a rear surface positioned to face an control pressure chamber 30 communicating with a signal detecting hydraulic line. The valve body 90 has a shape to maintain a balance between forces produced by a pressure in the control pressure chamber and acting upon the valve body. A slit 21 having a variable dead zone X2 is formed between the valve body 80 and the valve body 90 for detecting and introducing a pressure between an outlet portion of the flow distribution valve and an inlet portion of the hold check valve to the control pressure chamber. The casing structure and device construction of a directional control valve with postpositional type flow distribution valves are thereby simplified.

10 Claims, 13 Drawing Sheets

SOLE OPERATION

1. NEUTRAL

2. SPOOL OPEN, FLOW DISTRIBUTION VALVE OPEN, AND PUMP TILTING INCREASED

3. CHECK VALVE OPEN AND FLUID FLOWING INTO ACTUATOR

4. STEADY DRIVING

COMBINED OPERATION
(LOWER PRESSURE SIDE)

1. NEUTRAL CHECK VALVE CLOSED AND FLOW DISTRIBUTION VALVE CLOSED

2. SPOOL OPEN, FLOW DISTRIBUTION VALVE OPEN AND CHECK VALVE OPEN

COMPARATIVE EXAMPLE
(TWO METERING NOTCHES)

COMPARATIVE EXAMPLE
(FOUR METERING NOTCHES)

DIRECTIONAL CONTROL VALVE WITH FLOW DISTRIBUTION VALVES

TECHNICAL FIELD

The present invention relates to a directional control valve with flow distribution valves, and more particularly to a directional control valve with flow distribution valves, which is used in a hydraulic circuit for operating a plurality of actuators in a construction machine such as a hydraulic excavator, thereby ensuring a distribution characteristic during the combined operation.

BACKGROUND ART

For supplying a hydraulic fluid delivered from a hydraulic pump to a plurality of hydraulic actuators, it is conventional to provide a plurality of directional control valves in a delivery line of the hydraulic pump and shift the directional control valves selectively so that the hydraulic fluid is supplied to desired one of the hydraulic actuators. With this arrangement, however, when the hydraulic fluid is supplied to several hydraulic actuators at the same time, the hydraulic fluid is supplied to only the hydraulic actuator under a smaller load, and no hydraulic fluid is supplied to the hydraulic actuator under a larger load.

JP, B, 4-48967 and U.S. Pat. No. 5,305,789, for example, propose hydraulic circuits for overcoming such a problem.

In the hydraulic circuit proposed in JP, B, 4-48967, a plurality of directional control valves are provided in a delivery line of a hydraulic pump, and a pressure compensating valve for varying a setting differential pressure depending on a load sensing differential pressure (i.e., a differential pressure between a maximum load pressure among the plurality of directional control valves and a delivery pressure of the hydraulic pump) is provided in a circuit section between the hydraulic pump and a variable throttle of each of the directional control valves. The pressure compensating valve controls a differential pressure across the variable throttle.

In the hydraulic circuit proposed in U.S. Pat. No. 5,305,789, a plurality of directional control valves are provided in a delivery line of a hydraulic pump, and a pressure control valve responsive to a maximum load pressure is provided in a circuit section between a variable throttle of each of the directional control valves and each corresponding hydraulic actuator. The pressure control valve controls a pressure on the outlet side of the variable throttle to be kept substantially at the maximum load pressure.

Hereunder, the pressure compensating valve disclosed in JP, B, 4-48967 is referred to as the prepositional type and the pressure control valve disclosed in U.S. Pat. No. 5,305,789 is referred to as the postpositional type. Further, the prepositional type pressure compensating valve is referred to as a variable pressure compensating valve and the postpositional type pressure control valve is referred to as a flow distribution valve.

To effect the function of the variable pressure compensating valve or the flow distribution valve, the maximum load pressure is detected with a shuttle valve or the like and introduced to a signal line.

FIG. 12 shows the hydraulic circuit proposed in JP, B, 4-48967. A maximum load pressure detected by a shuttle valve 237 is output to a signal line 238. The maximum load pressure is transmitted through signal lines 239, 241 from the signal line 238 to one ends of variable pressure compensating valves 206, 216 provided respectively between a hydraulic pump 201 and directional control valves 208, 218.

When the maximum load pressure is transmitted in such a way, the variable pressure compensating valves 206, 216 operate so that the relationship of;

(pump pressure in line 240)—(maximum load pressure in line 239)=(pressure in line 225 upstream of variable throttle)—(pressure in line 224 downstream of variable throttle)

holds on the side of the directional control valve 208 and the relationship of;

(pump pressure in line 242)—(maximum load pressure in line 241)=(pressure in line 227 upstream of variable throttle)—(pressure in line 226 downstream of variable throttle)

holds on the side of the directional control valve 218. Because of;

(pump pressure in line 240)=(pump pressure in line 242), and (maximum load pressure in line 239)=(maximum load pressure in line 241)

differential pressures across the variable throttles of the directional control valves 208 and 218 are equal to each other.

Accordingly, even when a difference in load pressure exists between hydraulic actuators 212 and 222, a delivery rate of the hydraulic pump 201 is distributed depending on an opening area ratio between the variable throttles, and hence a hydraulic fluid is avoided from being supplied to the hydraulic actuator under a smaller load pressure with priority.

FIG. 13 shows the hydraulic circuit proposed in U.S. Pat. No. 5,305,789, and FIG. 14 shows one example of valve structure. A modification of the valve structure is shown in FIG. 15.

In FIGS. 13 and 14, a flow distribution valve 314, which serves also as a shuttle valve for detecting a maximum load pressure, is disposed between a directional control valve spool 304 and ports A, B connected to each hydraulic actuator. The maximum load pressure detected by the flow distribution valve 314 is introduced to a signal line 308 and then to other flow distribution valves 314 associated with corresponding directional control valves. With this arrangement, the flow distribution valve 314 on the side of the actuator under a lower load pressure is not opened until the pressure in an inlet line 312 of the flow distribution valve 314 becomes equal to the detected maximum load pressure in the signal line 308.

When a plurality of directional control valves associated with respective hydraulic actuators under load pressures different from each other are operated at the same time, the pressures in the inlet lines 312 of the flow distribution valves 314 associated with the operated directional control valves are all equal to the maximum load pressure. As a result, differential pressures across variable throttles of the directional control valve spools 304 are equal to each other in all the directional control valves. In this prior art, therefore, a delivery rate of a hydraulic pump is distributed depending on an opening area ratio between metering notches (variable throttles) 320 regardless of the magnitudes of load pressures as with the above prior art.

In the postpositional type arrangement, it is general that the flow distribution valve 314 is provided one for each directional control valve, as shown in FIGS. 13 and 14. FIG. 15 shows an example wherein two flow distribution valves are provided for each directional control valve in the postpositional type arrangement. In FIG. 15, because metering notches 320 formed on a spool 304 have functions of both flow rate control and direction control, the hydraulic fluid having passed the flow distribution valve 314 is supplied to the port A or B without passing the spool section again.

DISCLOSURE OF THE INVENTION

In a hydraulic circuit for operating a plurality of actuators, as described above, a pressure compensating valve or a pressure control valve is disposed to ensure a distribution characteristic during the combined operation to constitute the prepositional type arrangement shown in FIG. 12 or the postpositional type arrangement shown in FIGS. 13 and 14.

The prepositional type arrangement requires four signals to effect the functions of the variable pressure compensating valves 206, 216, whereas the postpositional type arrangement requires only one signal to effect the function of the flow distribution valve 314. Thus, the postpositional type arrangement is more advantageous in that the structure of a flow distribution valve section is fairly simplified in the postpositional type arrangement.

On the other hand, comparing a section where the spool is installed, the variable pressure compensating valves 206, 216 function in front of a metering notch (variable throttle) of the spool, and the functions of both flow rate control and direction control can be achieved by one spool land in the prepositional type arrangement.

In the postpositional type arrangement, the metering notches 320 of the spool 304 generally have only the function of flow rate control, as shown in FIG. 14. According, the postpositional type arrangement requires not only left and right ports 323, 324 and a spool land (directional control portion) for determining to which one of the ports A, B the hydraulic fluid having passed the flow distribution valve 314 is to be introduced, but also a bridge line 321 for connecting the port 323 and a flow distribution valve section to each other.

Thus, the postpositional type arrangement is more advantageous from the view point of the flow distribution valve section, and the prepositional type arrangement is more advantageous from the view point of the spool section.

The structure of FIG. 15 is proposed with intent to reduce the number of lands in the spool section while leaving the advantage of the postpositional type arrangement. In the proposed structure, the number of lands is reduced by using two flow distribution valves 314 and forming the metering notches 320, which have the functions of both flow rate control and direction control, on one land. From the stand point of spaces where the flow distribution valve 314 and a hold check valve 322, however, the proposed structure is such that high-pressure ports 325 and the ports A, B are arranged respectively at opposite ends and low-pressure ports 326 connected to a hydraulic fluid reservoir are arranged inward of the high-pressure ports 325. The proposed structure therefore has drawbacks below.

1) Since drain ports 400 are required to be formed at the opposite ends outward of the high-pressure ports 325, the number of ports formed around the spool is increased and the axial dimension of the spool is also increased correspondingly, resulting in a more complicated casing structure. When moving the spool directly in a mechanical way, the drain ports 400 can be dispensed with if oil seals are attached to the opposite ends of the spool. In such a case, however, the presence of the oil seals increases resistance and hence needs a greater operating force.

When moving the spool in a hydraulic way, oil seals are not needed, but there is a risk that high-pressure oil may leak into a spring chamber for the spool and give rise to a malfunction.

2) The low-pressure ports 326 and the drain ports 400 cannot be connected to each other in the same section. In the case of constructing stack type casings, therefore, it is troublesome to connect the adjacent casings.

3) Further, relief valves 500 allowing outward flows, which are used in FIG. 14, can be no longer used, and special relief valves 501 allowing inward flows are required in the construction of FIG. 10.

An object of the present invention is to provide a directional control valve with flow distribution valves, which has a postpositional type flow distribution valve and which is simplified in casing structure and device construction.

(1) To achieve the above object, according to the present invention, in a directional control valve with flow distribution valves, comprising a pair of metering notches formed on a land of a spool and having functions of both flow rate control and direction control, a pair of actuator ports, and a pair of flow distribution valves and a pair of hold check valves which are disposed between the pair of metering notches and the pair of actuator ports, respectively, (a) the pair of hold check valves comprise valve bodies in the form of hollow spools each having a seat portion, which constitutes an on/off valve, formed on an outer periphery and being subject to a pressure developed in an outlet passage communicating with one of the actuator ports to act in the valve-closing direction, and (b) the pair of flow distribution valves comprise valve bodies each being slidably fitted at least partially thereof in the hollow-spool valve body, and each having a front surface positioned to face an inlet passage communicating with the metering notch and a rear surface positioned to face an control pressure chamber communicating with a signal detecting hydraulic line.

In the present invention thus constructed, the flow distribution valve comprises one pair of postpositional type flow distribution valves disposed respectively between one pair of metering notches and one pair of actuator ports, and the valve body of each flow distribution valve is incorporated in the hollow-spool valve body of the hold check valve. Therefore, reservoir ports (low-pressure ports) for outflow control can be disposed outward of the actuator ports and the need of providing special drain ports is eliminated. Also, since the reservoir ports are disposed outward of the actuator ports, relief valves allowing outward flows as usual can be used. As a result, the casing structure and device construction can be simplified while leaving the advantage of a postpositional type flow distribution valve that the number of signals used is relatively small.

Incidentally, the present invention requires two flow distribution valves. In the combined operation of a hydraulic excavator, a variety of characteristics are demanded. When carrying out the combined operation of a boom and a swing, for example, a characteristic selected to suppress the function of a flow distribution valve is demanded in the operation of raising the boom, while a characteristic selected to enhance the function of the flow distribution valve is demanded in the operation of lowering the boom. Thus, the provision of two flow distribution valves is responsive to such a demand.

(2) In the above (1), preferably, the hollow-spool valve body of each hold check valve has a shape to maintain a balance between forces produced by a pressure in the control pressure chamber and acting upon the hollow-spool valve body.

The valve body of the flow distribution valve incorporated in the hollow-spool valve body of the hold check valve operates depending on a balance of forces developed by the pressure in the inlet passage and the pressure in the control pressure chamber. At this time, the pressure in the control pressure chamber also acts upon the hollow-spool valve body of the hold check valve. However, since the hollow-spool valve body of each hold check valve has a shape to maintain a balance between the forces produced by the pressure in the control pressure chamber, the valve body of the flow distribution valve is operated basically in a like manner to the prior art wherein the flow distribution valve and the hold check valve are separated from each other. Accordingly, there is no risk that a malfunction may occur due to the valve body of the flow distribution valve being incorporated in the hold check valve.

(3) In the above (1) or (2), preferably, the valve body of each flow distribution valve is configured to form load pressure detecting means capable of being opened and closed depending on a balance between a pressure in the input passage and a pressure in the control pressure chamber, between the valve body of the flow distribution valve and the hollow-spool valve body of the hold check valve, whereby a pressure in an intermediate chamber between an outlet portion of the flow distribution valve and an inlet portion of the hold check valve is detected and introduced to the control pressure chamber by the load pressure detecting means.

With this feature, since the valve body of the flow distribution valve and the hollow-spool valve body of the hold check valve cooperatively fulfill the function of a shuttle valve conventionally used for detecting the load pressure, the device construction can be simplified. Also, since the detected load pressure is a pressure in the intermediate chamber between the outlet portion of the flow distribution valve and the inlet portion of the hold check valve, it is possible to avoid such a problem that a load of the actuator is dropped upon detection of the load pressure.

(4) In the above (3), preferably, the load pressure detecting means comprises a slit formed in at least one of an outer periphery of the valve body of the flow distribution valve and an inner periphery of the hollow-spool valve body of the hold check valve, and a dead zone for communicating the intermediate chamber with the control pressure chamber through the slit only when the valve body of the flow distribution valve is moved beyond a predetermined distance with respect to the hollow-spool valve body of the hold check valve.

With this feature, when the hold check valve is going to open, the valve body of the flow distribution valve moves following the hollow-spool valve body of the hold check valve so that the dead zone of the load pressure detecting means is given as a variable dead zone. Therefore, the opening area of the flow distribution valve is increased correspondingly and a pressure loss caused in the flow distribution valve can be reduced.

(5) In the above (1), preferably, the valve body of the flow distribution valve is formed such that a diameter on the front surface side positioned to face the inlet passage is larger than a diameter on the rear surface side positioned to face the control pressure chamber.

With this feature, when the hydraulic fluid passes the flow distribution valve, an effect of fluid forces acting upon the valve body of the flow distribution valve can be abated.

(6) In the above (1), preferably, the hollow-spool valve body of the hold check valve is terminated by the seat portion, and the valve body of the flow distribution valve has a land slidably fitted in a casing to constitute a variable throttle.

With this feature, when the hydraulic fluid flows past the seat portion of the hold check valve, the hollow-spool valve body does not develop flow passage resistance and hence a pressure loss can be reduced.

(7) In the above (1), preferably, the hollow-spool valve body of the hold check valve has a spool extended portion extending from the seat portion into the inlet passage, the spool extended portion having a radial opening formed therein, and the valve body of the flow distribution valve has a land slidably fitted in the spool extended portion to constitute a variable throttle in cooperation with the opening.

With this feature, the spool extended portion serves as a guide when the hollow-spool valve body of the hold check valve is moved, whereby the hollow-spool valve body can be moved more smoothly.

(8) In the above (1), preferably, the valve body of the flow distribution valve has a land positioned between the inlet passage and the seat portion of the hold check valve, and metering notches each constituting a variable throttle are formed in three positions along a circumference of the land.

With this feature, a pressure loss caused by the notches is reduced and the movement of the valve body is made stable and smooth.

(9) In the above (8), preferably, the metering notches in three positions are formed in the land so that hydraulic forces acting upon respective notch surfaces are balanced.

With this feature, the movement of the valve body is made more stable and smooth.

(10) In the above (8), preferably, the metering notches in three positions are arranged with equal intervals in the circumferential direction.

With this feature, hydraulic forces acting upon respective notch surfaces are balanced and therefore the movement of the valve body is made more stable and smooth.

BEST MODE FOR CARRYING OUT THE INVENTION

Hereunder, embodiments of the present invention will be described with reference to the drawings.

A first embodiment of the present invention will be described with reference to FIGS. 1–9.

Figure 1:
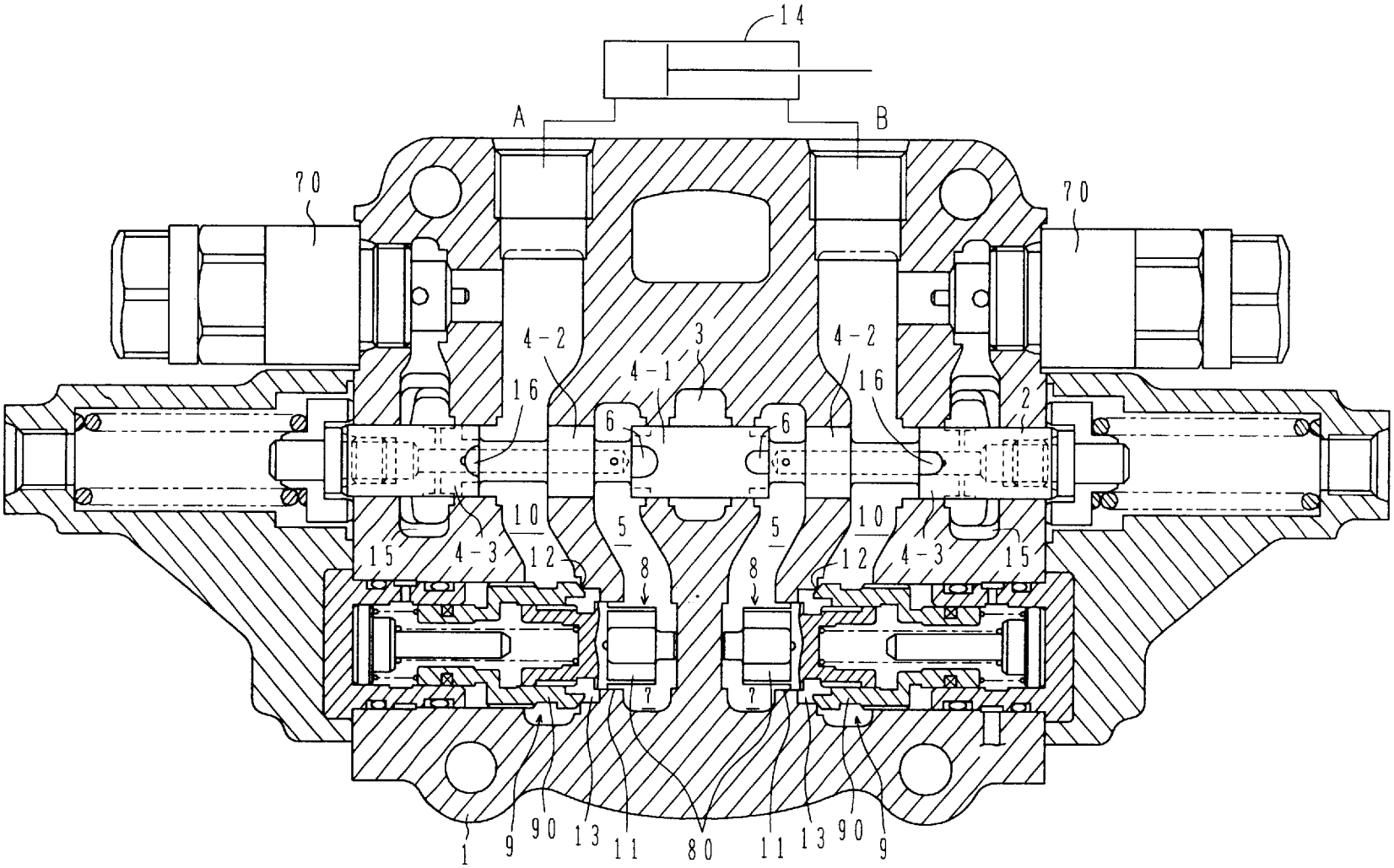
FIG. 1 a sectional view of a directional control valve according to a first embodiment of the present invention.

FIG. 1 a sectional view of a directional control valve according to this embodiment. A spool 2 is slidably inserted in a casing 1. The spool 2 is provided with one land 4-1 at the center and two pairs of lands 4-2, 4-3 one pair on each of both sides of the central land 4-1. The central land 4-1 has metering notches 6, 6 formed thereon for inflow control which have functions of both flow rate control and direction control. The lands 4-2, 4-2 on both sides of the central land 4-1 have no notches, and the lands 4-3, 4-3 on both outer sides of the lands 4-2, 4-2 have metering notches 16, 16 formed thereon for outflow control.

A hydraulic passage 3 is formed in a portion of the casing 1 where the central land 4-1 is to be positioned. The hydraulic passage 3 is connected to a delivery line 101*a* (see FIG. 2) of a hydraulic pump 100 (see FIG. 2). Hydraulic passages 5, 5 communicating with flow distribution valves 8, 8 are formed on both sides of the hydraulic passage 3 in sandwiching relation to the lands 4-1. Outlet side hydraulic passages 10, 10 of hold check valves 9, 9 are formed on both outer sides of the hydraulic passage 5, 5 in sandwiching relation to the lands 4-2, 4-2. The hydraulic passages 10, 10 are connected respectively to actuator ports A, B. The actuator ports A, B are connected respectively to the bottom side and the rod side of the actuator 14. Further, reservoir ports 15, 15 are formed on both outer sides of the hydraulic passage 10, 10 in sandwiching relation to the lands 4-3, 4-3, and relief valves 70, 70 allowing outward flows are installed between the actuator ports A, B and the reservoir ports 15, 15, respectively.

Figure 10:
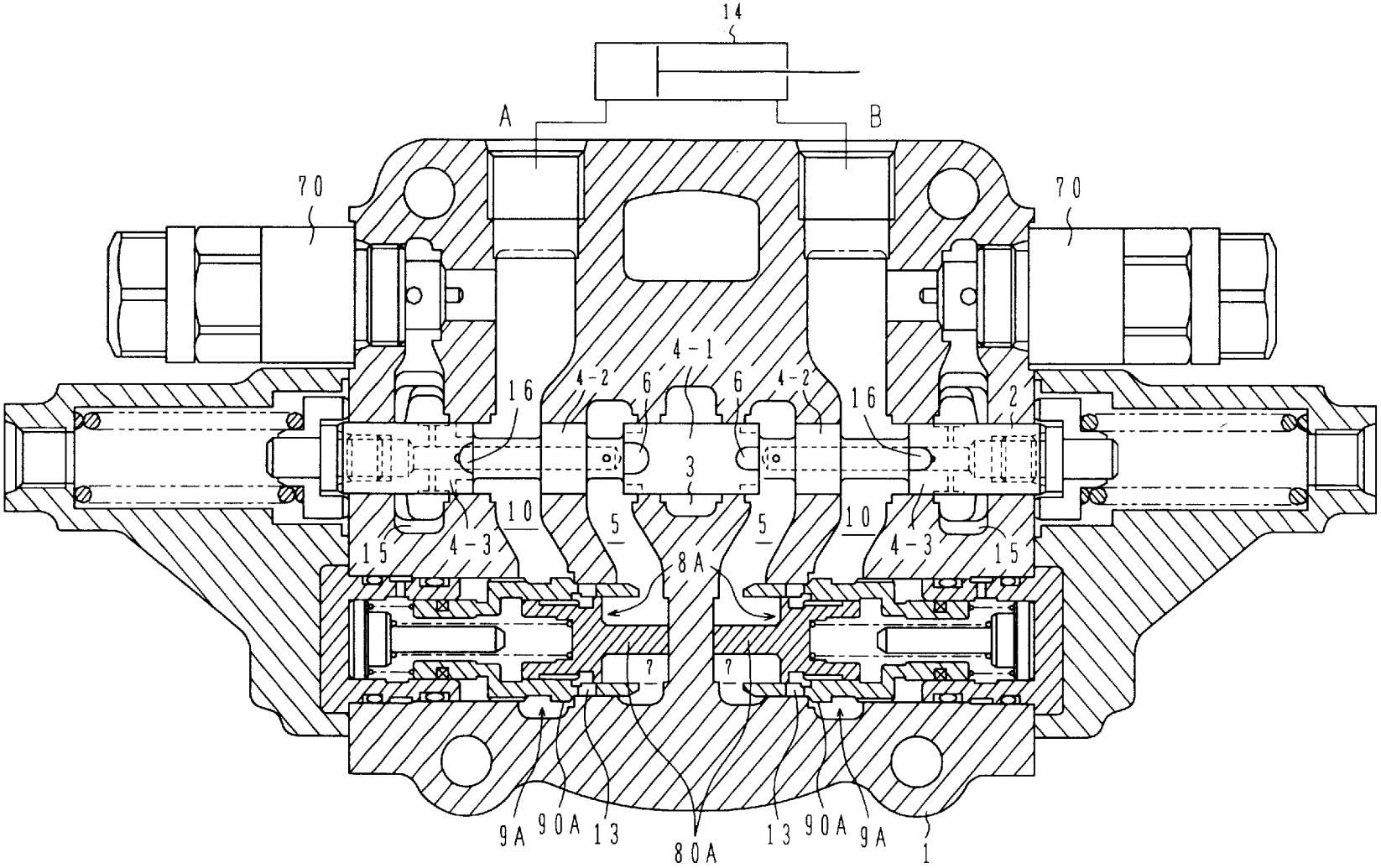
FIG. 10 a sectional view of a directional control valve according to a second embodiment of the present invention.

Thus, since the reservoir ports 15, 15 are formed outward of the lands 4-3, 4-3 on which the metering notches 16, 16 for outflow control are formed, there is no need of providing such special drain ports as provided in the prior art shown in FIG. 10, and the relief valves 70, 70 allowing outward flows as usual can be used.

The flow distribution valves 8, 8 are positioned in hydraulic passages 7, 7 communicating with the hydraulic passage 5, 5 and are partly incorporated in the hold check valves 9, 9 (described later), respectively.

A hydraulic fluid (oil) flows in the directional control valve as follows.

When the spool 2 is moved to the right, for example, as viewed in the drawing, the hydraulic fluid delivered from the hydraulic pump 100 (see FIG. 2) flows from the hydraulic passage 3 into the hydraulic passage 5 through the left-hand metering notch 6 formed on the spool 2. At this time, the hydraulic passage 3 is kept disconnected from the right-hand hydraulic passage 5. Further, the right-hand hydraulic passage 10 is communicated with the corresponding reservoir port 15, but the left-hand hydraulic passage 10 is kept disconnected from the corresponding reservoir port 15. The delivered hydraulic fluid flowing into the hydraulic passage 5 makes open the flow distribution valve 8 located in the hydraulic passage 7, and then flows into a signal detecting hydraulic line 13 (described later). When a delivery pressure of the hydraulic pump is higher than a load pressure in the hydraulic passage 10, the hydraulic fluid makes open the hold check valve 9 and then flows into the hydraulic passage 10 from the signal detecting hydraulic line 13, followed by being supplied the bottom side of the actuator 14 through the actuator port A. The hydraulic fluid returned from the rod side of the actuator 14 flows back to the reservoir port 15 through the actuator port B, the right-hand hydraulic passage 10, and the metering notch 16 formed on the spool 2.

The entire construction of the directional control valve and flows of the hydraulic fluid therein are as described above. Details of the flow distribution valve 8 and the hold check valve 9 will be described below with reference to FIG. 2.

Figure 2:
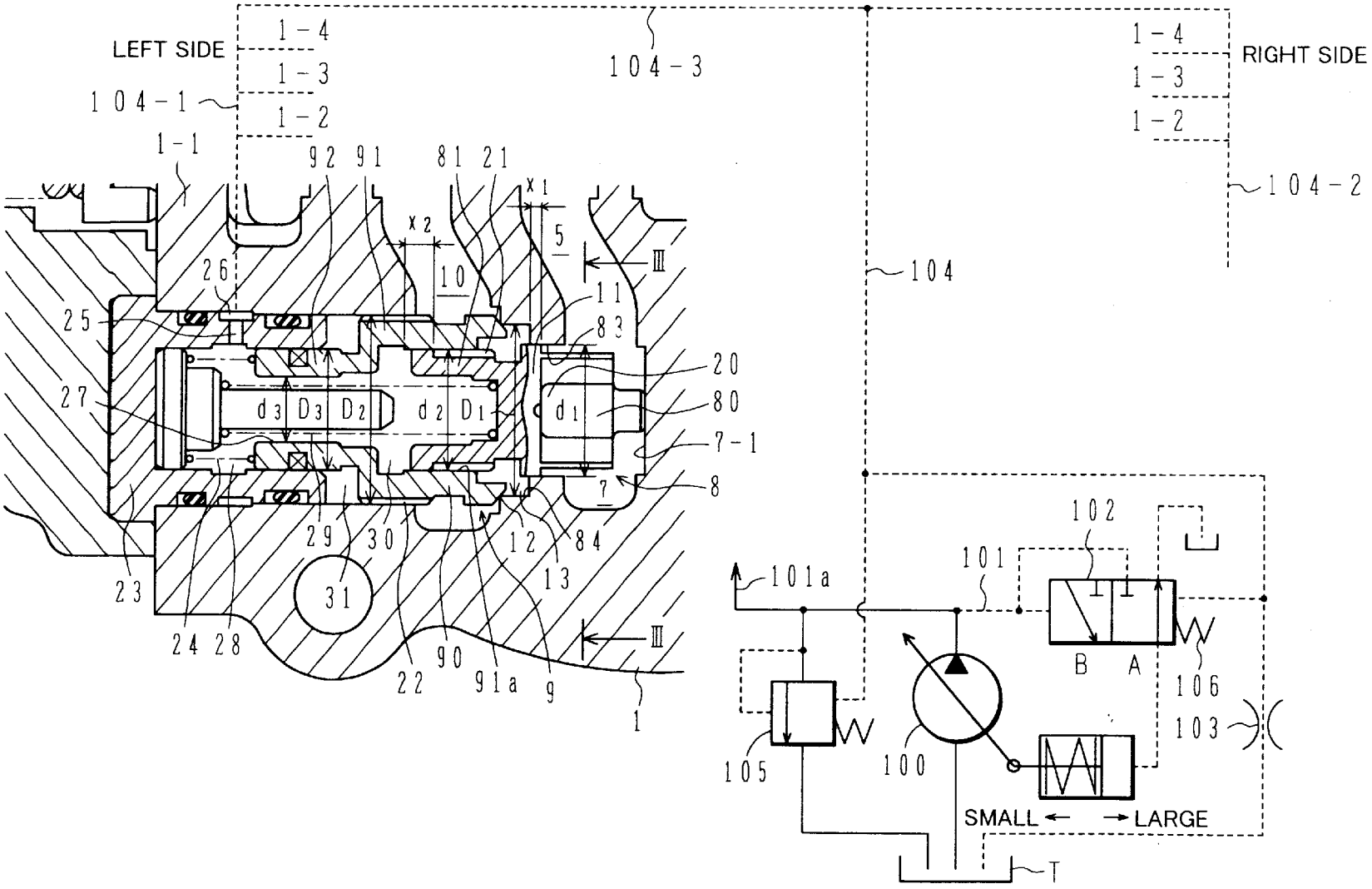
FIG. 2 is an enlarged view showing details of principal part of the directional control valve shown in FIG. 1.

In FIG. 2, the hold check valve 9 includes a valve body 90 in the form of a hollow spool which comprises a large-diameter portion 91 having an outer diameter D2 and an inner diameter d2, and a small-diameter portion 92 having an outer diameter D3 (<D2) and an inner diameter d3 (<d2). A seat portion 12 is provided at a distal end of the valve body 90 in the form of a hollow spool. The large-diameter portion 91 of the valve body 90 in the form of a hollow spool is slidably fitted in the casing 1, and the small-diameter portion 92 thereof is slidably fitted with an inner periphery of a sleeve 23 inserted in the casing 1. A load pressure chamber 31 is defined between a boundary step, which demarcates the large-diameter portion 91 and the small-diameter portion 92, and an end face of the sleeve 23. A plurality of slits 22 for guiding the load pressure from the hydraulic passage 10 to the load pressure chamber 31 are formed in an outer periphery of the large-diameter portion 91.

The flow distribution valve 8 includes a valve body 80 comprising a land 11 formed with a metering notch 20, and a stem portion 81. The stem portion 81 of the valve body 80 is slidably fitted in a bore 91*a* of the large-diameter portion 91 of the hollow-spool valve body 90 of the hold check valve 9, and a control pressure chamber 30 is defined by the stem portion 81 of the valve body 80 and the hollow-spool valve body 90 of the hold check valve 9. A hydraulic pressure in the signal detecting hydraulic line 13 is introduced to the control pressure chamber 30 through slits 21 formed in an outer periphery of the stem portion 81. The signal detecting hydraulic line 13 is formed, as described later, between the land 11 of the flow distribution valve 8 and the seat portion 12 of the hold check valve 9.

Further, the hold check valve 9 is fabricated to have the same dimension at the outer diameter D3 of the small-diameter portion 92 and the inner diameter d2 of the large-diameter portion 91 (=outer diameter of the stem portion 81 of the flow distribution valve 8) so that an effect of force caused by hydraulic pressure in the control pressure chamber 30 acting upon the hollow-spool valve body 90 of the hold check valve 9 can be nullified completely.

The control pressure chamber 30 is communicated with a spring chamber 28 of the hold check valve 9, which is defined in the sleeve 23, through a bore 27 of the small-diameter portion 92 of the hold check valve 9. The spring chamber 28 is communicated with a groove 26, which is defined by an outer periphery of the sleeve 23 and the casing 1, through a small hole 25 formed in a wall of the sleeve 23.

Assuming here that a plurality of directional control valves are provided comprises the illustrated directional control valve denoted by 1-1 and other directional control valves denoted by 1-2, 1-3, 1-4, . . . in sequence, grooves 26 formed in the directional control valves 1-2, 1-3, 1-4, . . . are communicated with one another in the order of 1-2, 1-3, 1-4, . . . from the directional control valve 1-1 by a signal detecting hydraulic line 104-1 formed in the casing 1.

Further, in FIG. 2, the signal detecting hydraulic line 104-1 is formed on the left side, and 104-2 denotes a signal detecting hydraulic line 104-2 on the right side. The left and right signal lines 104-1, 104-2 are then joined together by a signal line 104-3. A signal line 104 branched from the signal line 104-3 is connected to one end of a controller 102 for controlling the delivery rate of the hydraulic pump 100 so that a detected signal of maximum load pressure is transmitted to the controller 102.

The controller 102 operates depending on a differential pressure between a signal in a signal line 101 representing the delivery pressure of the hydraulic pump 100 and a maximum load pressure signal in the signal line 104, the differential pressure being set by a spring 106 provided at one end of the controller 102 to which the maximum load pressure signal line 104 is connected. After being branched to the controller 102 for transmitting the maximum load pressure, the signal line 104 is connected to a reservoir T through a throttle 103.

The land 11 of the valve body 80 of the flow distribution valve 8 extends into the hydraulic passage 7. The hydraulic passage 7 and the signal detecting hydraulic line 13 are normally disconnected from each other by the land 11. Also, the signal detecting hydraulic line 13 and the hydraulic passage 10 are normally disconnected from each other by the seat portion 12.

The land 11 of the valve body 80 of the flow distribution valve 8 has an outer diameter d1 larger than the outer diameter d2 of the stem portion 81 for reducing fluid forces, and is slidably inserted in a through hole 83 formed between the hydraulic passage 7 and the hydraulic passage 10. An opening 84 of the through hole 83 on the side of the hydraulic passage 10 has an inner diameter D1 that is larger than the outer diameter d1 of the land 11, but smaller than the outer diameter D2 of the large-diameter portion 91 of the hold check valve 9. The seat portion 12 of the hold check valve 9 is held in contact with an edge of the opening 84. Thus, in the opening 84, an intermediate chamber is defined between the land 11 of the flow distribution valve 8 and the seat portion 12 of the hold check valve 9, the intermediate chamber serving as the signal detecting hydraulic line 13.

The valve body 80 of the flow distribution valve 8 is normally biased by the pressure in the control pressure chamber 30 and a spring 29 so as to abut against an inner wall 7-1 of the hydraulic passage 7. The hollow-spool valve body 90 of the hold check valve 9 is normally biased by the pressure in the load pressure chamber 31 and a spring 24 so that the seat portion 12 is held in contact with the edge of the opening 84.

Further, the land 11 has a dead zone X1 for the metering notch 20 of the flow distribution valve 8 which is positioned between the hydraulic passage 7 and the signal detecting hydraulic line 13, and the stem portion 81 has a dead zone X2 for the slits 21 of the flow distribution valve 8 which are formed located in the hollow-spool valve body 90 of the hold check valve 9 for introducing the load pressure therethrough. The dead zones X1, X2 are selected to meet the relationship of X1<X2. When the dead zone X2 becomes zero, the pressure in the signal detecting hydraulic line 13 is introduced to the control pressure chamber 30.

The dead zone X2 is fixed with respect to the hollow-spool valve body 90 of the hold check valve 9 itself, but is changed depending on a position of the hollow-spool valve body 90 when the hollow-spool valve body 90 is moved to the left as viewed in the drawing. The dead zone X2 can be therefore called a variable dead zone.

Figure 3:
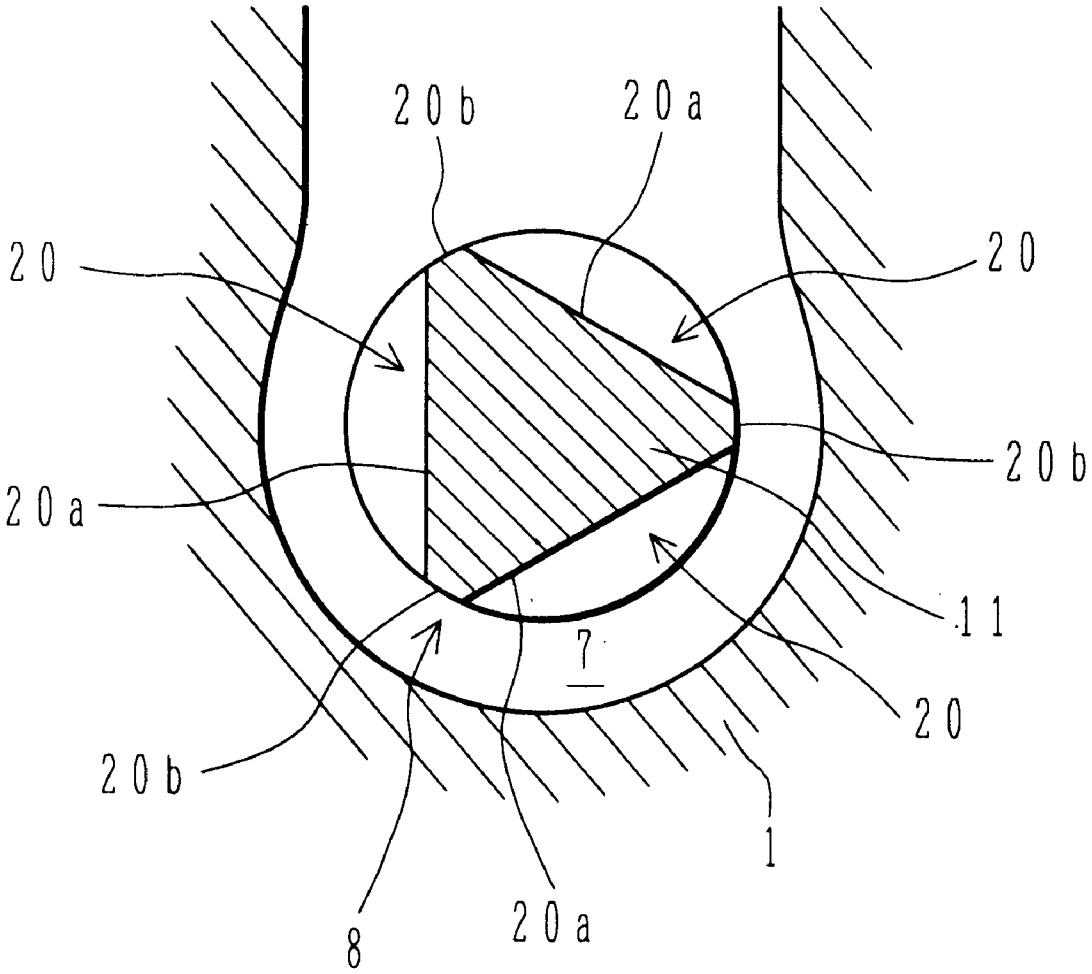
FIG. 3 is a sectional view taken along line III—III in FIG. 2.
Figure 4A:
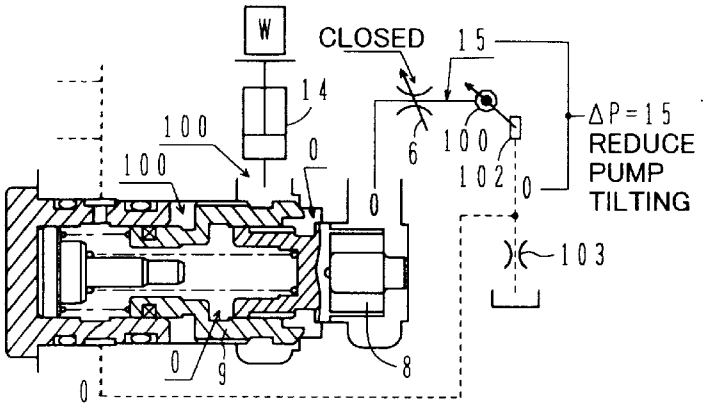
FIGS. 4(*a*)–4(*d*) are views showing an operating state in the sole operation.
Figure 4B:
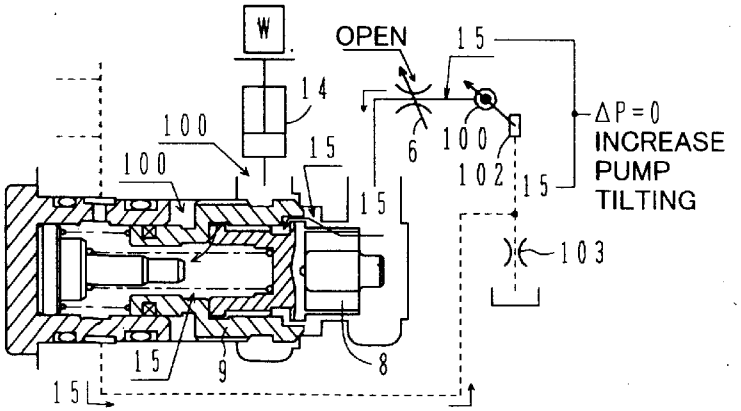
Figure 4C:
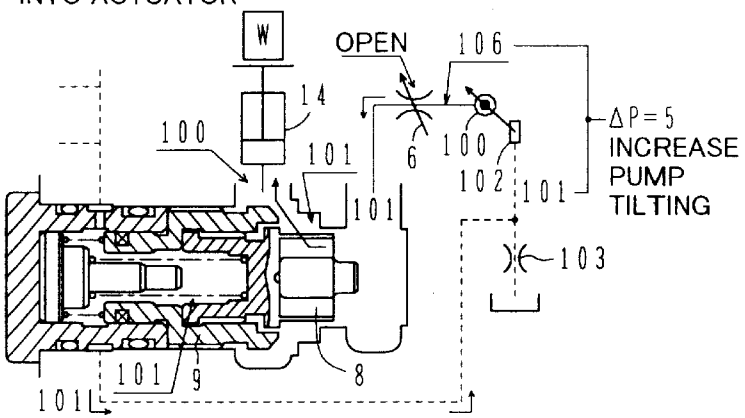
Figure 4D:
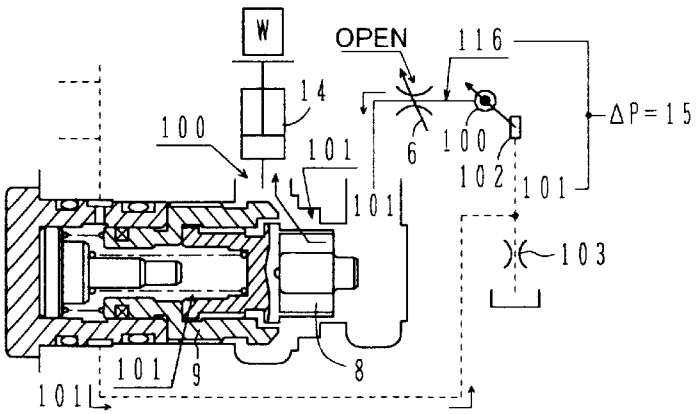

As shown in the sectional view of FIG. 3, the metering notch 20 of the flow distribution valve 8 is formed in three positions along a circumference of the land 11 such that three notches 20 are arranged with equal intervals in the circumferential direction. Also, each metering notch 20 has a shape defined by a flat surface 20*a*. A portion between the flat surfaces 20*a* of the metering notches 20 serves as a guide portion 20*b*.

Figure 5A:
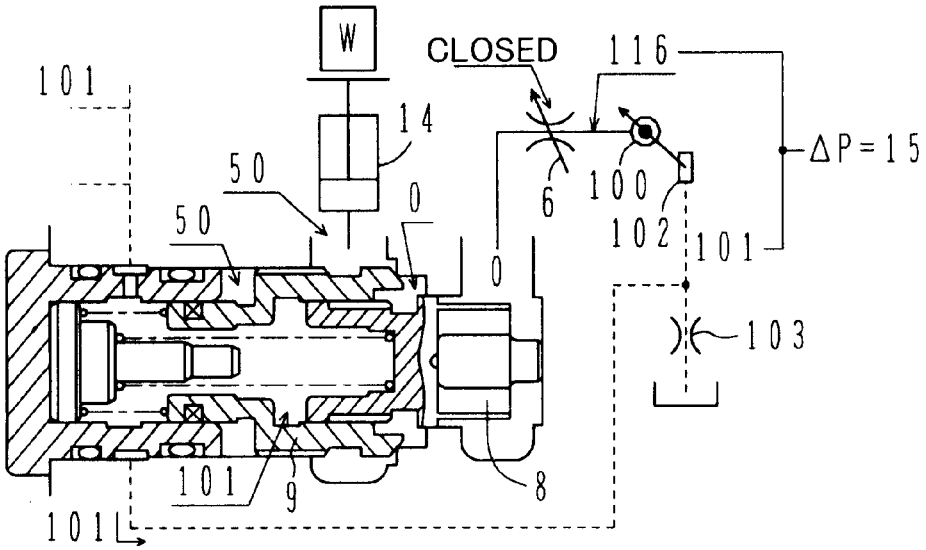
FIGS. 5(*a*) and 5(*b*) are views showing an operating state in the combined operation.
Figure 5B:
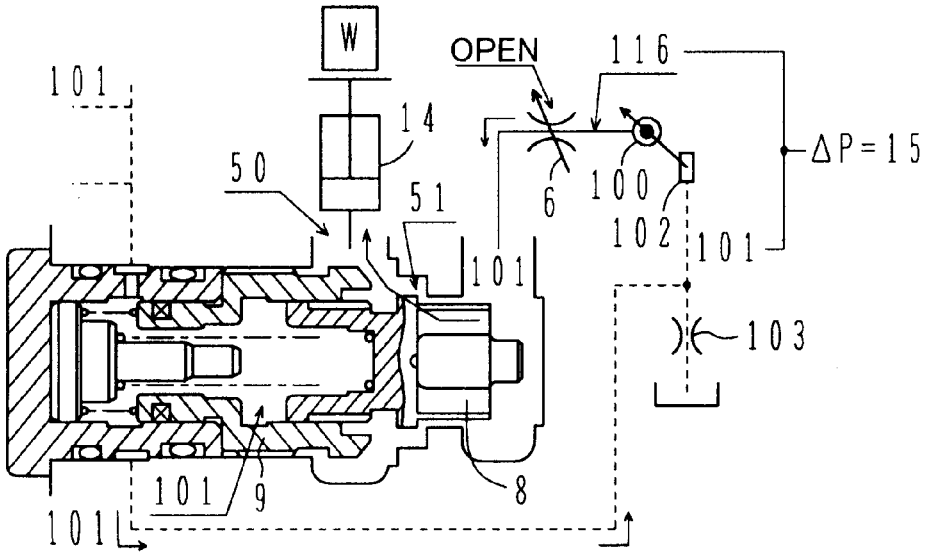

The operating function of the directional control valve thus constructed will now be described with reference to FIGS. 4 and 5. Numerals affixed to arrows in FIGS. 4 and 5 indicate, by way of example, pressures at positions pointed by the arrows.

(A) Neutral State

When no directional control valves are operated and all the spools 2 are in their neutral positions shown in FIG. 1, the signal detecting hydraulic line 104 is kept substantially at the reservoir pressure. Therefore, the controller 102 for the hydraulic pump 100 is in a position (B) of FIG. 2 and the delivery rate of the hydraulic pump 100 is held at a preset minimum delivery rate. Thus, the hydraulic fluid is returned to the reservoir T at the minimum delivery rate through an unloading valve 105. In this state, the hollow-spool valve body 90 of the hold check valve 9 is biased by the pressure in the load pressure chamber 31 and the spring 24 so that the seat portion 12 is held in contact with the edge of the opening 84. Accordingly, even with a load acting upon the actuator 14, a load drop is avoided (see FIG. 4(*a*)).

(B) In Sole Operation

When the directional control valve 1-1 shown in FIG. 1 is operated and the spool 2 is moved to the right, for example, as viewed in the drawing, the delivered hydraulic fluid flows into the left-hand hydraulic passages 5, 7 from the hydraulic passage 3. At this time, the pressure of the delivered hydraulic fluid corresponds to the setting pressure of the unloading valve 105, but the pressure in the control pressure chamber 30 of the flow distribution valve 8 is substantially close to the reservoir pressure, and therefore the valve body 80 of the flow distribution valve 8 is moved to the left (FIG. 4(*a*) 4(*b*)). When the valve body 80 of the flow distribution valve 8 is moved by a distance corresponding to the dead zone X1, the metering notches 20 are opened and the valve body 80 is brought into an open state, whereupon the hydraulic passage 7 and the signal detecting hydraulic line 13 are communicated with each other. If the pressure in the load pressure chamber 31 of the hold check valve 9 is not lower than the setting pressure of the unloading valve 105 at this time, the hold check valve 9 remains closed.

When the valve body 80 of the flow distribution valve 8 is further moved to the left to such an extent as exceeding the dead zone x2 which is defined by the stem portion 81 of the valve body 80 and the hollow-spool valve body 90 of the hold check valve 9, the hydraulic pressure in the signal detecting hydraulic line 13 is introduced to the control pressure chamber 30 through the slits 21 formed in the outer periphery of the stem portion 81 and then transmitted to the signal line 104. At this time, since the flow of the hydraulic fluid is given by only a flow passing the throttle 103 provided in the signal line 104, the delivery pressure of the hydraulic pump 100 in the signal line 101 and the detected pressure in the signal line 104 are substantially equal to each other, whereby the controller 102 for the hydraulic pump 100 is pushed back toward a position (A) and the delivery rate of the hydraulic pump 100 is increased. Therefore, the pressure in the oil passage 7 rises from the setting pressure of the unloading valve 105 to make open the hold check valve 9 (FIG. 4(*b*)→4(*c*)). After that, the delivery pressure of the hydraulic pump 100 rises until reaching a level higher than the detected pressure in the signal line 104 by a setting value, followed by coming into a steady state (FIG. 4(*c*)→4(*d*); (c) and (d) represent a state where a passing flow rate is maximum).

In the above process, since the hydraulic fluid detected to provide the maximum load pressure and introduced to the signal line 104 is the hydraulic fluid delivered from the hydraulic pump 100, it is possible to avoid such a problem that a load of the actuator 14 is dropped upon detection of the load pressure.

Additionally, if the valve body 80 of the flow distribution valve 8 remains standstill when the hollow-spool valve body 90 of the hold check valve 9 is moved to the left as viewed in the drawing, the communication between the slits 21 and the control pressure chamber 30 is cut off, whereupon the pressure in the control pressure chamber 30 is lowered. Therefore, the valve body 80 of the flow distribution valve 8 is further moved to the left to maintain a balanced state. In other words, the valve body 80 of the flow distribution valve 8 operates following the hollow-spool valve body 90 of the hold check valve 9 while the dead zone X2 is variable in position.

Figure 15:
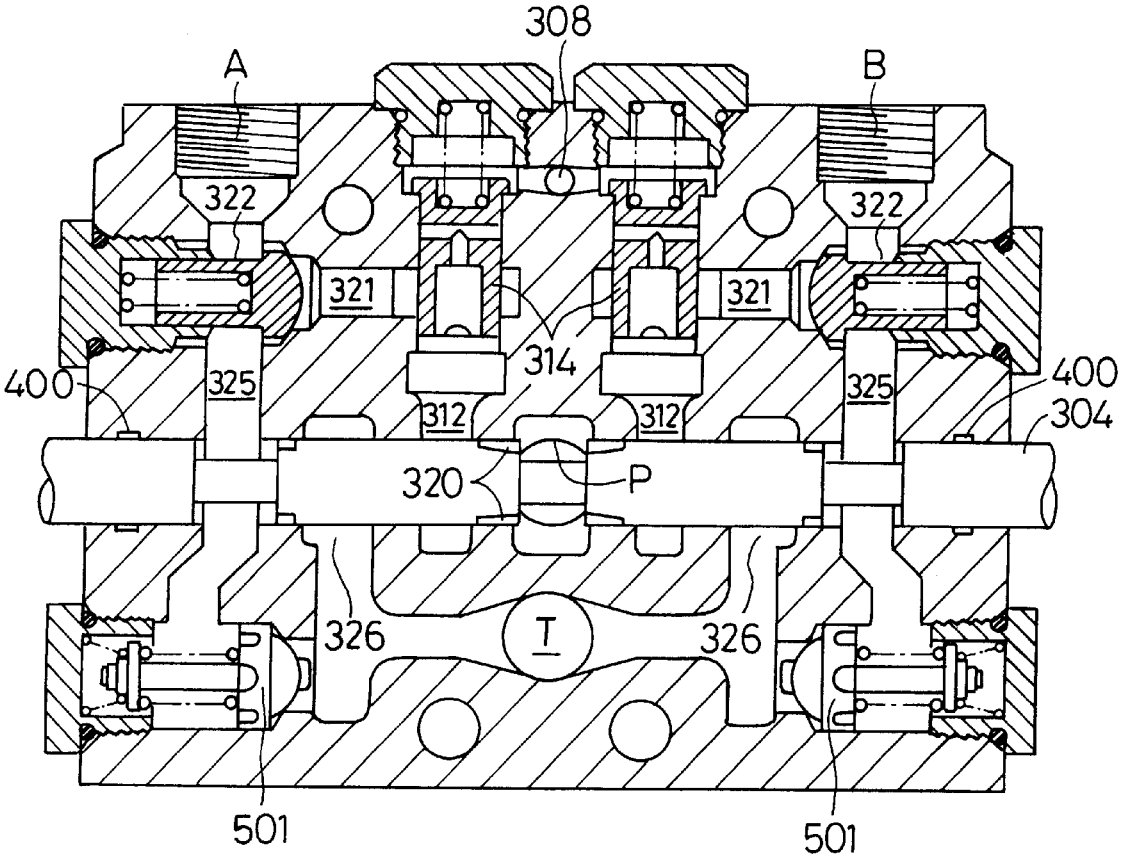
FIG.15 PRIOR ART
FIG. 15 is a structural view of a modification of the prior art shown in FIG. 13.

Here, in the prior-art valve structure shown in FIG. 15, because a dead zone for a load pressure detecting slit is fixed, a maximum opening area of the flow distribution valve 14 is constant. By contrast, in the present invention, because the dead zone X2 is variable in position, the valve body 80 of the flow distribution valve 8 moves following the hollow-spool valve body 90 of the hold check valve 9, and a displacement of the valve body 80 of the flow distribution valve 8 is increased to enlarge an opening area correspondingly. As a result, a pressure loss caused in the flow distribution valve 8 is reduced.

Also, when the valve body 80 of the flow distribution valve 8 is opened and the hydraulic fluid flows from the hydraulic passage 7 into the hydraulic passage 10 as described above, fluid forces acts upon the valve body 80 of the flow distribution valve 8, causing the valve body 80 to move in the valve-closing direction. In this embodiment, however, since the outer diameter d1 of the land 11 of the valve body 80 of the flow distribution valve 8 is set larger than the outer diameter d2 of the stem portion 81, an effect of those fluid forces can be abated. Incidentally, the valve body 80 can be assembled in place even with the outer diameter d1 set larger than the outer diameter d2.

Further, since the metering notch 20 of the flow distribution valve 8 is formed and arranged in three positions with equal intervals along the circumference of the land 11, a pressure loss caused by the notches is reduced and the valve body 80 can be moved stably and smoothly (described later).

(C) In Combined Operation I

Assume now that the load pressure of the actuator 14 associated with the directional control valve 1-2 shown in FIG. 2 is higher than the load pressure of the actuator 14 associated with the directional control valve 1-1, and the spool is operated to move the flow distribution valve 8 and the hold check valve 9 on the left side of only the directional control valve 1-2. In this case, a high-pressure signal is transmitted from the side of the directional control valve 1-2 to the control pressure chamber 30 of the directional control valve 1-1 (FIG. 5(*a*)).

When the spool 2 shown in FIG. 1 is operated to the right to move the flow distribution valve 8 and the hold check valve 9 on the left side of only the directional control valve 1-1 in the above state, the delivered hydraulic fluid flows into the left-hand hydraulic passages 5, 7 from the hydraulic passage 3. Then, when a pressure matching with the high-pressure signal transmitted to the control pressure chamber 30 is developed in the hydraulic passage 7, the valve body 80 of the flow distribution valve 8 is brought into an open state and the hold check valve 9 is opened (FIG. 5(*a*)→5(*b*); (b) represents a state where a passing flow rate is maximum). This means that the directional control valve 1-2 on the higher pressure side and the directional control valve 1-1 on the lower pressure side provide the same differential pressure across the metering notch 6, and that the delivery rate of the hydraulic pump 100 is distributed depending on an opening area ratio between the respective metering notches 6.

Here, because the directional control valve 1-1 is on the lower pressure load side, a pressure loss corresponding to a difference between the load pressures of the two actuators must be created between the hydraulic passage 7 and the signal detecting hydraulic line 13. If the valve body 80 of the flow distribution valve 8 for the directional control valve 1-1 on the lower load side is displaced similarly to that of the flow distribution valve on the higher load side, the pressure in the hydraulic passage 7 is substantially equal to the load pressure of the actuator 14 associated with the directional control valve 1-1 (on the lower load side), and therefore the valve body 80 is moved back in the valve-closing direction due to the high-load signal in the control pressure chamber 30. Conversely, if the valve body 80 is overly closed, the pressure in the hydraulic passage 7 exceeds the pressure in the control pressure chamber 30 and the valve body 80 is moved in the valve-opening direction. Accordingly, a valve movement of the flow distribution valve 8 for the directional control valve 1-1 on the lower load side is achieved with a displacement not less than the dead zone X1, but not more than the dead zone X2; hence the pressure on the higher load side is prevented from being reversely transmitted to the actuator on the lower load side through the slits 21 of the flow distribution valve 8.

(D) In Combined Operation II

The operated resulted when the spool 2 is operated to move the flow distribution valve 8 and the hold check valve 9 on the left side of the directional control valve 1-1 from a state where the load pressure of the actuator 14 associated with the directional control valve 1-1 is higher than the load pressure of the actuator 14 associated with the directional control valve 1-2 and the spool is operated to move the flow distribution valve 8 and the hold check valve 9 on the left side of only the directional control valve 1-2, is essentially the same as in the above (B) sole operation except that the control pressure chamber 30 of the directional control valve 1-1 is supplied with a pressure signal from the directional control valve 1-2.

In this case, since the hydraulic fluid detected to provide the maximum load pressure and introduced to the signal line 104 is the hydraulic fluid delivered from the hydraulic pump 100, it is also possible to avoid such a problem that a load of the actuator 14 is dropped upon detection of the load pressure.

Also, because the dead zone X2 used for detecting the load pressure is a variable dead zone, the valve body 80 of the flow distribution valve 8 moves following the hollow-spool valve body 90 of the hold check valve 9, a pressure loss caused in the flow distribution valve 8 for the directional control valve 1-1 on the higher pressure side is reduced.

This embodiment constructed as described above can provide advantages below.

(1) Since the flow distribution valve comprises one pair of postpositional type flow distribution valves 8 and the valve body 80 of each flow distribution valve 8 is incorporated in the valve body (hollow-spool valve body) 90 of the hold check valve 9, the reservoir ports (low-pressure ports) 15, 15 for outflow control can be disposed outward of the actuator ports A, B and the need of providing special drain ports is eliminated. Also, since the reservoir ports 15, 15 are disposed outward of the actuator ports A, B, the relief valves 70, 70 allowing outward flows as usual can be used.

Also, since load pressure detecting means comprises the slits 21 between the valve body 80 of the flow distribution valve 8 and the hollow-spool valve body 90 of the hold check valve 9, a shuttle valve conventionally used for detecting the load pressure can be omitted.

As a result, the casing structure and device construction can be simplified while leaving the advantage of a postpositional type flow distribution valve that the number of signals used is relatively small.

(2) Since the detected load pressure is a pressure in the signal detecting hydraulic line (intermediate chamber) 13 between the outlet portion of the flow distribution valve 8 and the inlet portion of the hold check valve 9, it is possible to avoid such a problem that a load of the actuator 14 is dropped upon detection of the load pressure.

(3) When the hold check valve 9 is going to open, the valve body 80 of the flow distribution valve 8 moves following the hollow-spool valve body 90 of the hold check valve 9 so that the dead zone X2 of the load pressure detecting means is given as a variable dead zone. Therefore, the opening area of the flow distribution valve is increased correspondingly and a pressure loss caused in the flow distribution valve can be reduced.

(4) Since the outer diameter d1 of the land 11 of the valve body 80 of the flow distribution valve 8 is set larger than the outer diameter d2 of the stem portion 81, an effect of fluid forces acting upon the valve body 80 of the flow distribution valve 8 can be abated.

(5) Since the hollow-spool valve body 90 of the hold check valve 9 is terminated by the seat portion 12, the hollow-spool valve body 90 does not develop flow passage resistance when the hydraulic fluid passes the seat portion 12. A pressure loss can be reduced in this point as well.

(6) Since the metering notch 20 of the flow distribution valve 8 is formed and arranged in three positions with equal intervals along the circumference of the land 11, a pressure loss caused by the notches is reduced and the valve body 80 can be moved stably and smoothly. This advantage will now be described in more detail with reference to FIGS. 6–8.

(6-1) First, in this embodiment, since the metering notch 20 of the flow distribution valve 8 is formed in three positions along the circumference of the land 11, a pressure loss caused by the notches is reduced and the movement of the valve body 80 is made stable and smooth with the presence of three guide portions 20*b*.

Figure 6A:
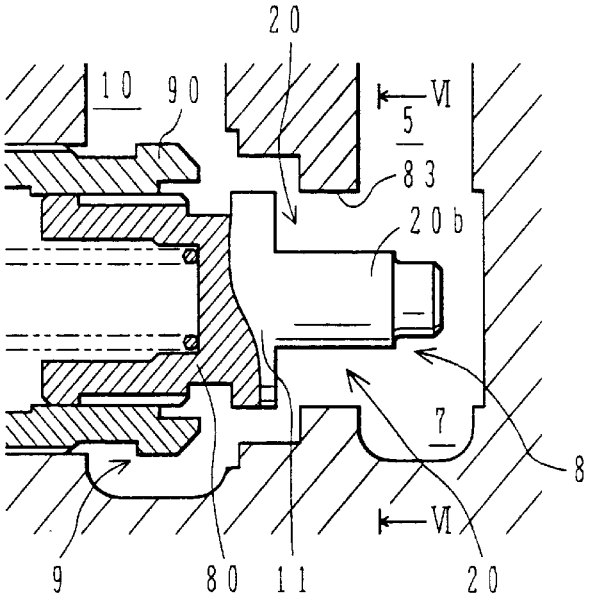
FIG. 6(*a*) is a view showing a comparative example in which two metering notches are provided, and FIG. 6(*b*) is a sectional view taken along line VI—VI in FIG. 6(*a*).
Figure 6B:
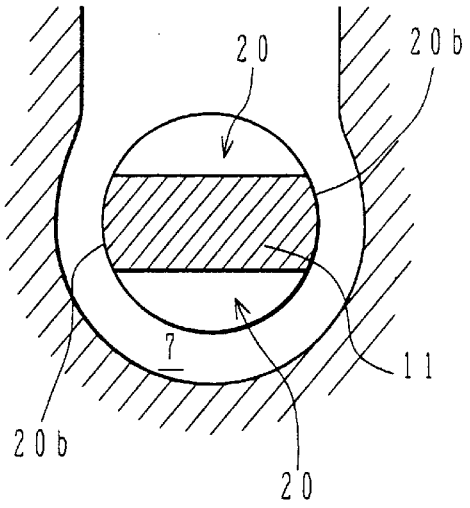
Figure 7A:
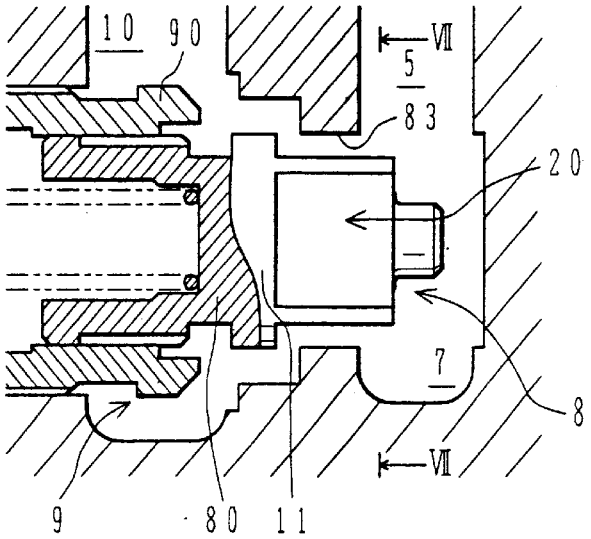
FIG. 7(*a*) is a view showing a comparative example in which four metering notches are provided, and FIG. 7(*b*) is a sectional view taken along line VII—VII Fin FIG. 7(*a*).
Figure 7B:
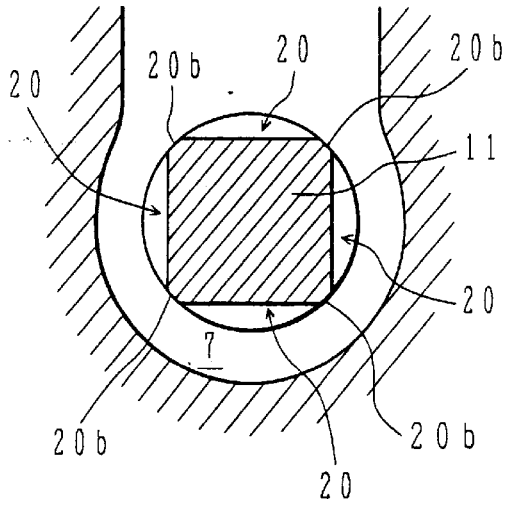

FIGS. 6 and 7 show, as comparative examples, the cases where the metering notch 20 is formed respectively in two or four positions along the circumference of the land 11.

Where the metering notch is formed in two positions as shown in FIG. 6, the notch area is increased and the pressure loss can be reduced. However, because of only two guide portions being provided between the notches, a supporting state of the valve body is unstable and such a trouble as sticking is likely to occur.

Where the metering notch is formed in four positions as shown in FIG. 7, the guide portion between the notches is provided four and a supporting state of the valve body is so stable as to ensure smooth movement. However, the notch area is decreased and therefore the pressure loss is increased. If the land diameter is increased, a large notch area would be maintained, but the device size is enlarged.

Figure 8:
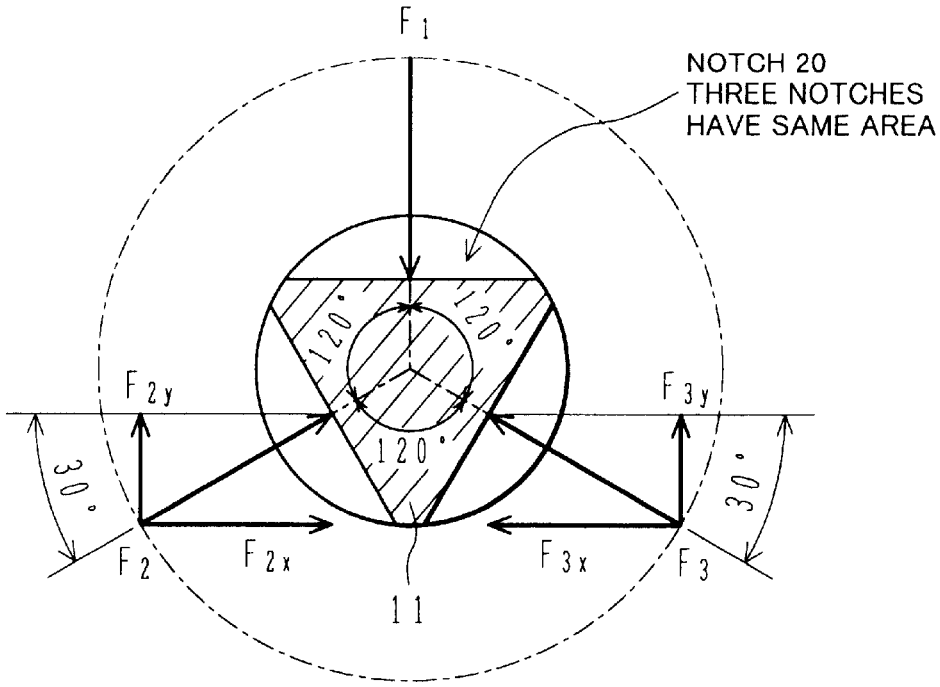
FIG. 8 is a view for explaining a balance among hydraulic forces acting on the metering notches.

(6-2) Secondly, in this embodiment, since the metering notch 20 of the flow distribution valve 8 is formed and arranged in three positions with equal intervals along the circumference of the land 11, hydraulic pressures radially acting upon the notches 20 are balanced and the movement of the valve body 80 is made stable and smooth in this point as well. FIG. 8 is a view for explaining such an advantage.

In FIG. 8, $F_1$, $F_2$ and $F_3$ represent hydraulic pressures radially acting upon respective surfaces 20*a* of the three notches 20. Because all the notches 20 have the same area in three positions, the magnitude of the hydraulic pressures $F_1$, $F_2$ and $F_3$ are all equal to one another. Also, assuming that components of the hydraulic pressures $F_2$ and $F_3$ in a direction perpendicular to the hydraulic pressure $F_1$ are $F_{2x}$ and $F_{3x}$ and components thereof in the same direction as the hydraulic pressure $F_1$ are $F_{2y}$ and $F_{3y}$, since the hydraulic pressures $F_1$, $F_2$ and $F_3$ intersect one another at an angle of 120°, these hydraulic pressures are balanced because of $F_{2x}=F_{3x}$ and $F_2+F_3=F_1$. Accordingly, no unbalance forces are produced due to the hydraulic pressures $F_1$, $F_2$ and $F_3$, enabling the valve body 80 move stable and smoothly.

Figure 9:
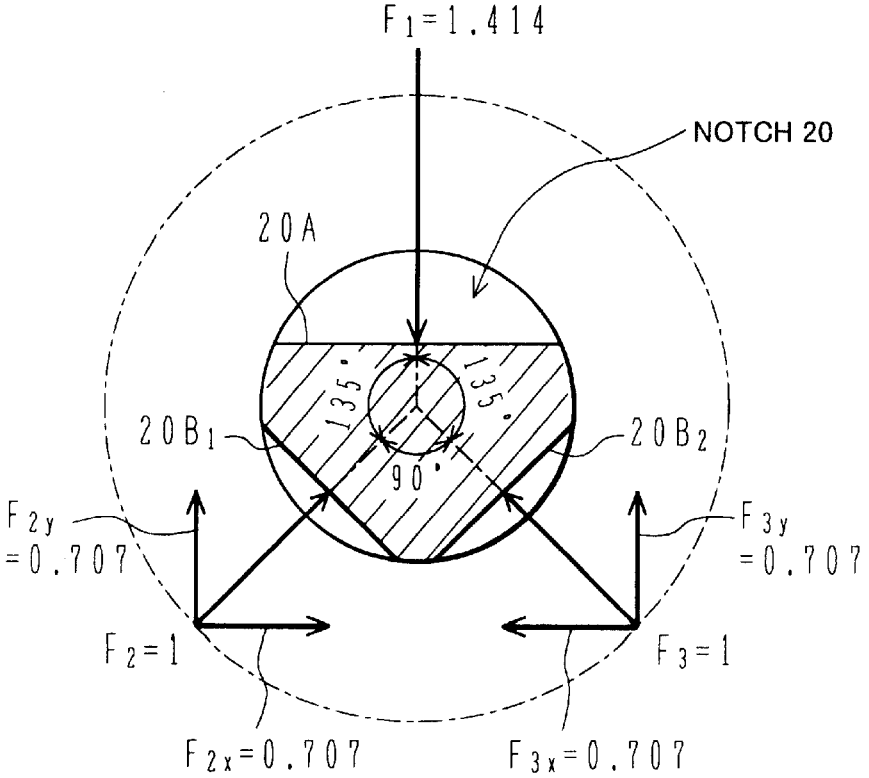
FIG. 9 is a view showing other shapes of the metering notches for establishing a balance among hydraulic forces.

FIG. 9 shows a modification in the shape of the metering notch. While in the above embodiment the three metering notches 20 are formed and arranged with equal angular intervals to establish a balance among the hydraulic pressures $F_1$, $F_2$ and $F_3$, the three metering notches 20 are not necessarily formed and arranged with equal angular intervals.

In the modification of FIG. 9, the three metering notches are defined by respective surfaces 20A, 20$B_1$ and 20$B_2$ such that the surfaces 20$B_1$, 20$B_2$ intersect the surface 20A at an angle of 135° and the surfaces 20$B_1$, 20$B_2$ intersect each other at an angle of 90°. Also, areas of the surfaces 20A, 20$B_1$ and 20$B_2$ are set such that the hydraulic pressure $F_1$ acting upon the surface 20A is 1.414 times the hydraulic pressures $F_2$, $F_3$ acting upon the surfaces 20$B_1$, 20$B_2$. In this modification, assuming that components of the hydraulic pressures $F_2$ and $F_3$ acting upon the surfaces 20$B_1$ and 20$B_2$ in a direction perpendicular to the hydraulic pressure $F_1$ are $F_{2x}$ and $F_{3x}$ and components thereof in the same direction as the hydraulic pressure $F_1$ are $F_{2y}$ and $F_{3y}$, these hydraulic pressures are balanced because of $F_{2x}=F_{3x}$ and $F_{2y}+F_{3y}=F_1$ for the same reason as mentioned above. Accordingly, the valve body 80 can be moved stable and smoothly as with the above embodiment.

A second embodiment of the present invention will be described with reference to FIGS. 10 and 11. In these drawings, equivalent members to those in FIGS. 1 and 2 are denoted by the same reference numerals and a description thereof is omitted here.

Figure 11:
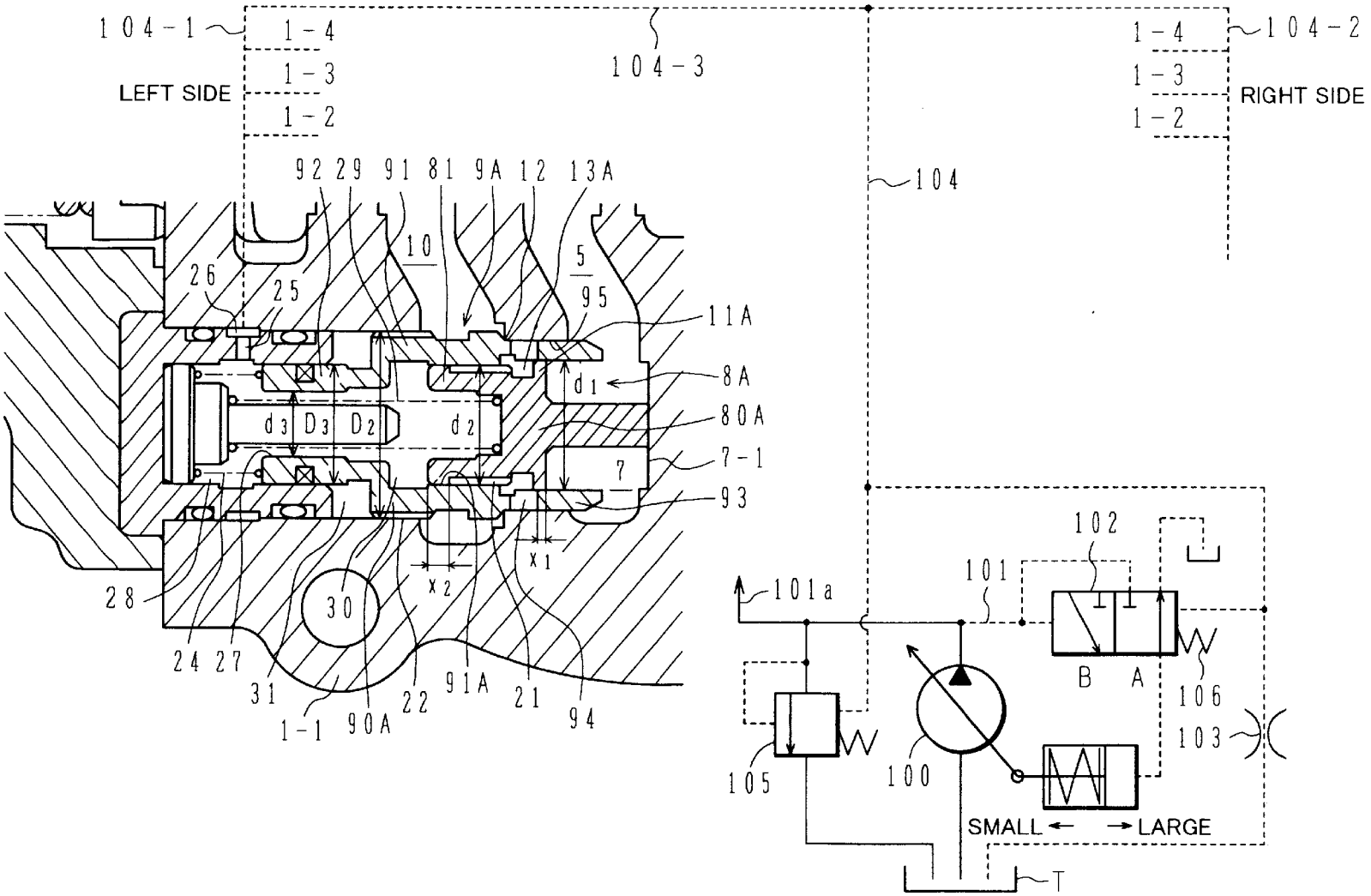
FIG. 11 is an enlarged view showing details of principal part of the directional control valve shown in FIG. 10.
Figure 12:
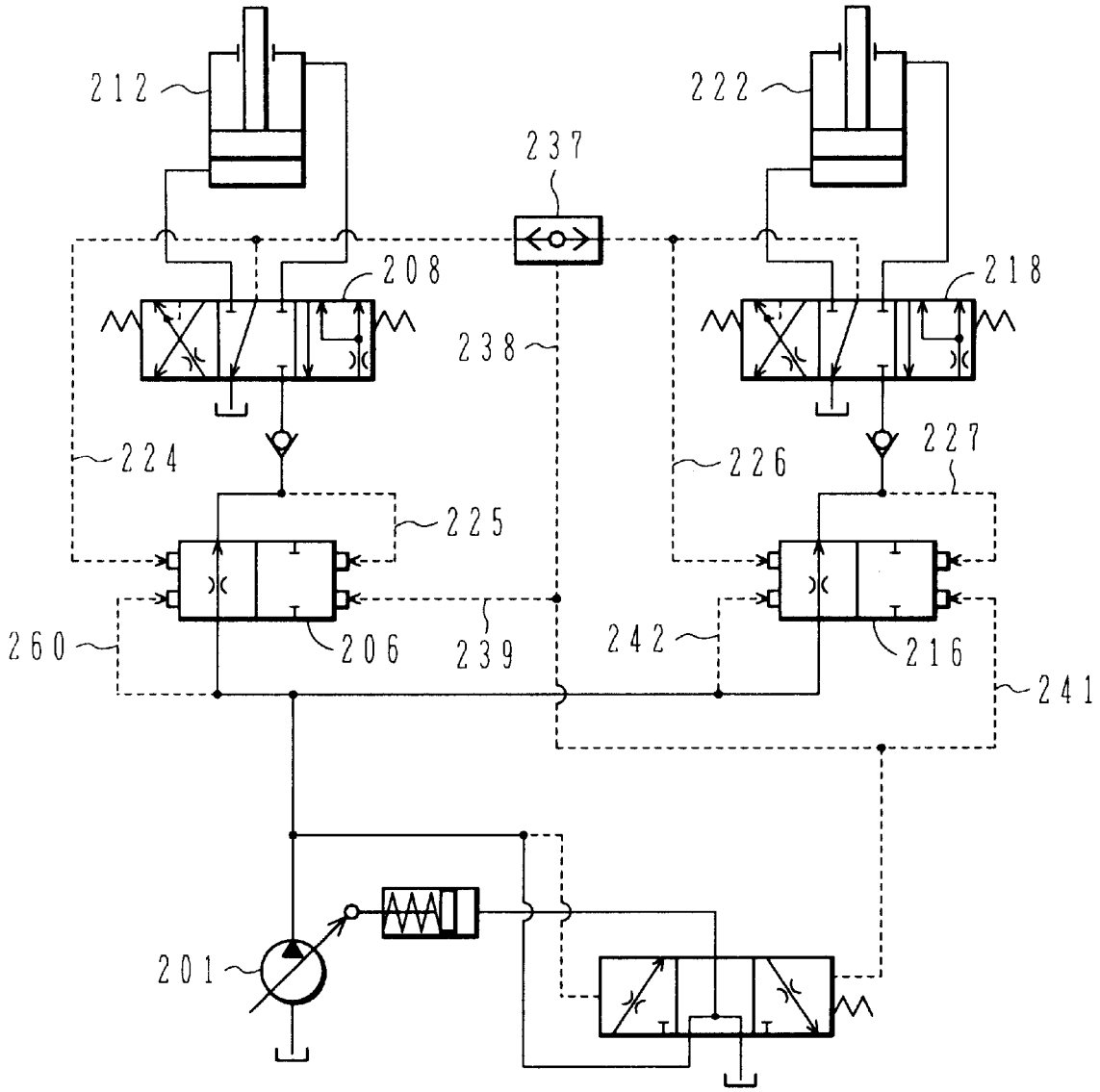
FIG.12 PRIOR ART
FIG. 12 is a circuit diagram of prior art.
Figure 13:
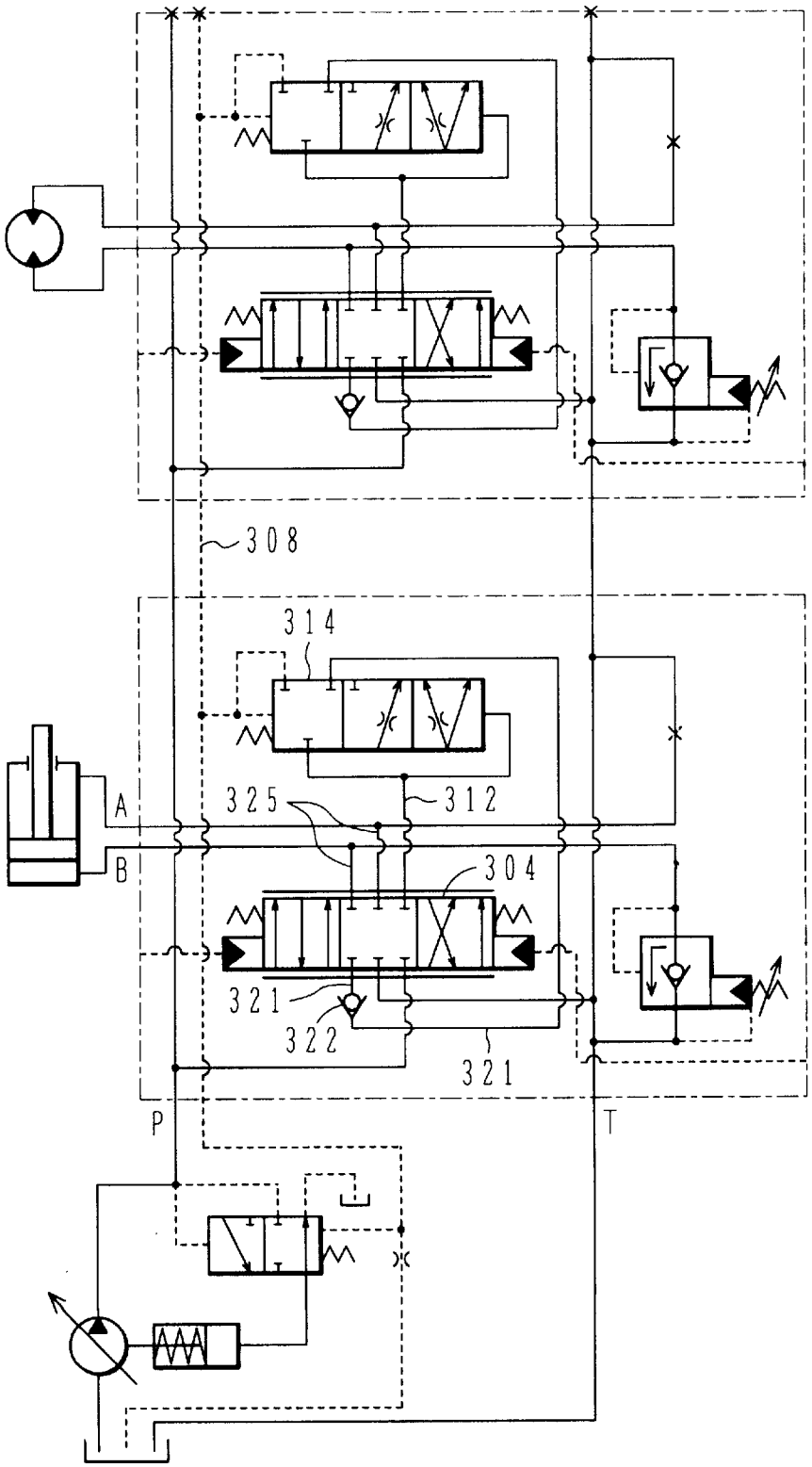
FIG.13 PRIOR ART
FIG. 13 is a circuit diagram of another prior art.
Figure 14:
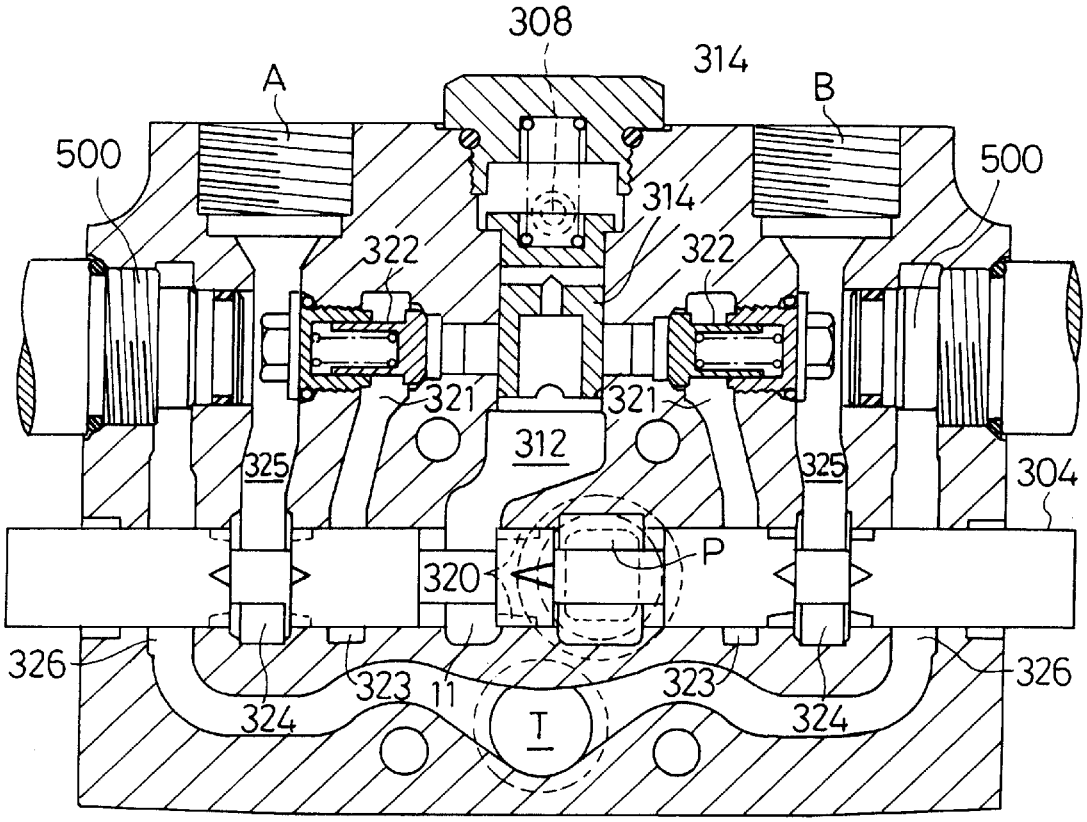
FIG.14 PRIOR ART
FIG. 14 is a structural view of the prior art shown in FIG. 13.

In FIGS. 10 and 11, a directional control valve of this embodiment differs from that of the first embodiment in shapes of a valve body 80A of a flow distribution valve 8A and a hollow-spool valve body 90A of a hold check valve 9A.

More specifically, in this embodiment, the hollow-spool valve body 90A of the hold check valve 9A has a spool extended portion 93 extending from the seat portion 12 into the hydraulic passage 7. The spool extended portion 93 is slidably fitted in a through hole 95 formed between the hydraulic passage 7 and the hydraulic passage 10. Also, a radial opening 94 for communicating a signal detecting hydraulic line 13A with the hydraulic passage 10 is formed in the spool extended portion 93, and a land 11A of the valve body 80A of the flow distribution valve 8A is slidably fitted in the spool extended portion 93, so that the opening 94 and the land 11A cooperatively constitute a variable throttle. Furthermore, as with the first embodiment, the land 11A of the valve body 80A of the flow distribution valve 8A has an outer diameter d1 larger than the outer diameter d2 of the stem portion 81.

The first embodiment has such an advantage that since the hollow-spool valve body 90 of the hold check valve 9 is terminated by the seat portion 12, the hollow-spool valve body 90 does not develop flow passage resistance when the hydraulic fluid passes the seat portion 12, and hence a pressure loss can be reduced. From the point of supporting the hollow-spool valve body 90, however, because the end on the side of the seat portion 12 is a free end, there is a risk that a supporting state of the hollow-spool valve body 90 is unstable. In this embodiment, with the provision of the spool extended portion 93, the hollow-spool valve body 90A is supported at both ends, resulting in that the hollow-spool valve body 90A is supported in a stable state and can be moved more smoothly.

INDUSTRIAL APPLICABILITY (1) According to the present invention, since the reservoir ports (low-pressure ports) for outflow control can be disposed outward of the actuator ports, the need of providing special drain ports is eliminated and the relief valves allowing outward flows as usual can be used. As a result, the casing structure and device construction can be simplified while leaving the advantage of a postpositional type flow distribution valve that the number of signals used is relatively small.

(2) Also, according to the present invention, since the valve body of the flow distribution valve and the hollow-spool valve body of the hold check valve cooperatively fulfill the function of a shuttle valve conventionally used for detecting the load pressure, the device construction can be further simplified.

(3) Moreover, since the detected load pressure is a pressure residing between the outlet portion of the flow distribution valve and the inlet portion of the hold check valve, it is possible to avoid such a problem that a load of the actuator 14 is dropped upon detection of the load pressure.

(4) According to the present invention, since the valve body of the flow distribution valve moves following the hollow-spool valve body of the hold check valve so that the dead zone of the load pressure detecting means is given as a variable dead zone, the opening area of the flow distribution valve is increased and a pressure loss caused in the flow distribution valve can be reduced.

(5) According to the present invention, since the outer diameter of the land of the valve body of the flow distribution valve is set larger than the outer diameter of the stem portion, an effect of fluid forces acting upon the valve body of the flow distribution valve can be abated.

(6) According to the present invention, since the hollow-spool valve body of the hold check valve is terminated by the seat portion, the hollow-spool valve body does not develop flow passage resistance when the hydraulic fluid passes the seat portion and hence a pressure loss can be reduced.

(7) According to the present invention, since the spool extended portion is provided to extend from the seat portion of the hollow-spool valve body, the hollow-spool valve body is supported at both ends and can be moved more smoothly.

(8) Finally, according to the present invention, since the metering notch of the flow distribution valve is formed in three positions along the circumference of the land, a pressure loss caused by the notches is reduced and the valve body of the flow distribution valve can be moved stably and smoothly.

We claim:

1. A directional control valve with flow distribution valves, comprising a pair of metering notches (6, 6) formed on a land (4-1) of a spool (2) and having functions of both flow rate control and direction control, a pair of actuator ports (A, B), and a pair of flow distribution valves (8, 8; 8A, 8A) and a pair of hold check valves (9, 9; 9A, 9A) which are disposed between said pair of metering notches and said pair of actuator ports, respectively, wherein:

(a) said pair of hold check valves (9, 9; 9A, 9A) comprise valve bodies (90; 90A) in the form of hollow spools each having a seat portion (12) formed on an outer periphery and being subject to a pressure developed in an outlet passage (10) communicating with one of said actuator ports (A, B) to act in the valve-closing direction, and (b) said pair of flow distribution valves (8, 8; 8A, 8A) comprise valve bodies (80; 80A) each being slidably fitted at least partially thereof in said hollow-spool valve body (90; 90A), and each having a front surface positioned to face an inlet passage (7) communicating with said metering notch (6) and a rear surface positioned to face an control pressure chamber (30) communicating with a signal detecting hydraulic line (13).

2. A directional control valve with flow distribution valves according to claim 1, wherein said hollow-spool valve body (90; 90A) of said each hold check valve (9; 9A) has a shape to maintain a balance between forces produced by a pressure in said control pressure chamber (30) and acting upon said hollow-spool valve body.

3. A directional control valve with flow distribution valves according to claim 1 or 2, wherein said valve body (80; 80A) of said each flow distribution valve (8; 8A) is configured to form load pressure detecting means (21) capable of being opened and closed depending on a balance between a pressure in said input passage (7) and a pressure in said control pressure chamber (30), between said valve body (80; 80A) of said each flow distribution valve (8; 8A) and said hollow-spool valve body (90; 90A) of said each hold check valve (9; 9A) whereby a pressure in an intermediate chamber (13) between an outlet portion of said flow distribution valve and an inlet portion of said hold check valve is detected and introduced to said control pressure chamber (30) by said load pressure detecting means.

4. A directional control valve with flow distribution valves according to claim 3, wherein said load pressure detecting means comprises a slit (21) formed in at least one of an outer periphery of said valve body (80; 80A) of said flow distribution valve (8; 8A) and an inner periphery of said hollow-spool valve body (90; 90A) of said hold check valve (9; 9A), and a dead zone (X2) for communicating said intermediate chamber with said control pressure chamber through said slit only when said valve body of said flow distribution valve is moved beyond a predetermined distance with respect to said hollow-spool valve body of said hold check valve.

5. A directional control valve with flow distribution valves according to claim 1, wherein said valve body (80; 80A) of said flow distribution valve (8; 8A) is formed such that a diameter (d1) on the front surface side positioned to face said inlet passage (7) is larger than a diameter (d2) on the rear surface side positioned to face said control pressure chamber (30).

6. A directional control valve with flow distribution valves according to claim 1, wherein said hollow-spool valve body (90) of said hold check valve (9) is terminated by said seat portion (12), and said valve body (80) of said flow distribution valve (8) has a land (11) slidably fitted in a casing (1) to constitute a variable throttle.

7. A directional control valve with flow distribution valves according to claim 1, wherein said hollow-spool valve body (90A) of said hold check valve (9A) has a spool extended portion (93) extending from said seat portion (12) into said inlet passage (7), said spool extended portion having a radial opening (94) formed therein, and said valve body (80A) of said flow distribution valve (8A) has a land (11A) slidably fitted in said spool extended portion (93) to constitute a variable throttle in cooperation with said opening (94).

8. A directional control valve with flow distribution valves according to claim 1, wherein said valve body (80) of said flow distribution valve (8) has a land (11) positioned between said inlet passage (7) and said seat portion (12) of said hold check valve (9A), and metering notches (20) each constituting a variable throttle are formed in three positions along a circumference of said land.

9. A directional control valve with flow distribution valves according to claim 8, wherein said metering notches (20) in three positions are formed in said land (11) so that hydraulic forces acting upon respective notch surfaces are balanced.

10. A directional control valve with flow distribution valves according to claim 8, wherein said metering notches (20) in three positions are arranged with equal intervals in the circumferential direction.

* * * * *